US006941680B1

(12) United States Patent
Zielewicz et al.

(10) Patent No.: US 6,941,680 B1
(45) Date of Patent: Sep. 13, 2005

(54) COST-EFFICIENT CLOTHES DRYER

(76) Inventors: Robert Zielewicz, 198 Deyo Hill Rd., Johnson City, NY (US) 13790; Karen Zielewicz, 198 Deyo Hill Rd., Johnson City, NY (US) 13790; Sarah Zielewicz, 198 Deyo Hill Rd., Johnson City, NY (US) 13790; Matthew Zielewicz, 198 Deyo Hill Rd., Johnson City, NY (US) 13790; Emily Zielewicz, 198 Deyo Hill Rd., Johnson City, NY (US) 13790

( * ) Notice: Subject to any disclaimer, the term of this patent is extended or adjusted under 35 U.S.C. 154(b) by 7 days.

(21) Appl. No.: 10/612,262

(22) Filed: Jul. 3, 2003

(51) Int. Cl.[7] ..... F26B 11/02
(52) U.S. Cl. ..... 34/607
(58) Field of Search ..... 34/602, 603, 604, 34/606, 607; 165/111, 113

(56) References Cited

U.S. PATENT DOCUMENTS

| | | | | | |
|---|---|---|---|---|---|
| 3,333,345 | A | * | 8/1967 | Miller | 34/528 |
| 3,651,580 | A | * | 3/1972 | Meyer | 34/602 |
| 3,833,127 | A | * | 9/1974 | Schoen et al. | 211/119.008 |
| 4,204,339 | A | * | 5/1980 | Muller | 34/75 |
| 4,330,083 | A | * | 5/1982 | Di Fiore | 237/56 |
| 4,401,261 | A | * | 8/1983 | Brown | 236/10 |
| 4,412,391 | A | * | 11/1983 | Bolognino | 34/90 |
| 4,514,914 | A | * | 5/1985 | Kitzmiller | 34/93 |
| 4,891,892 | A | * | 1/1990 | Narang | 34/86 |
| 5,946,814 | A | * | 9/1999 | Farrant | 34/103 |

FOREIGN PATENT DOCUMENTS

| | | | | |
|---|---|---|---|---|
| DE | 34 159 81 | * | 10/1985 | D06F 58/00 |
| EP | 0 456 173 | * | 11/1991 | D06F 58/26 |
| JP | 1-303 199 | * | 12/1989 | D06F 58/10 |
| JP | 2004-89415 | * | 3/2004 | D06F 58/24 |

* cited by examiner

*Primary Examiner*—Stephen Gravini
(74) *Attorney, Agent, or Firm*—Mark Levy & Associates; David L. Banner

(57) ABSTRACT

A clothes dryer that is operatively attached to a heating system is illustrated. The clothes dryer receives heated fluid when the dryer is turned on. The dryer has a radiator that receives the heated fluid from the circulating fluid flow system. The fluid-filled radiator radiates heat into a clothes-drying chamber, which forms part of a motor-driven, rotating drum. The rotating drum tumbles the clothes as heat is projected into the drying chamber, thus driving the moisture from the clothes.

19 Claims, 5 Drawing Sheets

COST-EFFICIENT CLOTHES DRYER

FIELD OF THE INVENTION

The invention pertains to clothes dryers and, more particularly, to a cost-efficient clothes dryer that is connected to the heating system of a house and operates as a heating zone peripheral.

BACKGROUND OF THE INVENTION

In certain areas of the country where energy costs are high, running an electrically operated clothes dryer can be very expensive. Gas operation is not always a choice in some areas, leaving the homeowner with few options other than running a costly electric clothes dryer. Even where gas is available, operating a gas-fired clothes dryer can still be inefficient. A large portion of the heat transferred to the drying chamber is vented to the atmosphere without heating the clothes. Other advantages include no chance of fire caused by gas or electric heat sources, and elimination of overheating and scorching fabrics since temperatures of water/heat radiation are lower than gas or electric heat sources.

A home heating system is often designed to supply heat to different parts of a house. In larger homes, the heating system is often separated into zones of heating, where certain parts of the house demand more heat than do other parts.

The present invention is a clothes dryer that operates as part of the heating system of a home. The clothes dryer is operatively connected in the same way as a zone thermostat, and makes a demand from the heating system in a similar fashion. Therefore, the present invention is a clothes dryer system that integrally is both part of the home heating system, and acts as a peripheral heating zone.

In zone heating using heated water, the water is fed to a radiator or baseboard, which transfers the heat to a room of the house by means of radiation. The thermostat in the room senses when the temperature in the room has fallen below a set level and sends a signal for heated water or sometimes steam to be sent through the pipes to the room making the demand. Many hot water boilers in homes today operate year-round as they are being called upon to heat domestic hot water as well as provide heat for the home. Often, this is accomplished through the use of an indirect-fired hot water heater that also acts as a heating zone peripheral, thus making the present invention a suitable addition to a boiler system that is already being utilized year-round to provide domestic hot water.

The clothes dryer of the present invention operates in a similar fashion to the thermostat. Turning on the clothes dryer sends a signal to the boiler to send heated water or steam through pipes connected to the clothes dryer. The heated fluid enters a radiator unit of the clothes dryer and causes heat to radiate into the clothes-drying chamber. The chamber forms part of a rotating drum that tumbles the clothes as they absorb heat. Wet or damp clothes deposited within the chamber absorb the heat and drive the moisture out of the fabrics.

The drying chamber comprises a sensor that senses the moisture level. The sensor sends a signal to a blower or venting apparatus in order to flush the chamber of moisture. As the moisture is vented to the atmosphere and the moisture level reaches a dry condition within the chamber, the sensor sends a signal to the boiler to suspend further fluid supply. Drying is a constant process as air and heat are blown into the chamber. Settings on the dryer control panel provide for selective choice between an extremely dry or damp condition for the drying operation. A simple, conventional timer may also be used to specify a predetermined time interval (e.g., 10, 20, . . . , 90 minutes).

SUMMARY OF THE INVENTION

In accordance with the present invention, there is featured a clothes dryer that is connected to, and operates as part of, a home heating system. The clothes dryer is operatively attached to the home heating boiler and receives heated fluid when the dryer is turned on. The dryer comprises a heat-exchanging radiator, which receives the heated fluid from the fluid flow system. The fluid-filled radiator radiates heat into a clothes-drying chamber, which forms part of a motor-driven, rotating drum. The rotating drum tumbles the clothes as heat is projected into the drying chamber, thus driving the moisture from the clothes.

A sensor in the chamber senses when a given moisture level has been reached inside the chamber and sends a signal to a blower or venting system to draw the moisture out of the chamber. The sensor also senses when the moisture level has dropped to a given dryness level and, thereafter, sends a signal to the fluid supply to terminate feeding heated fluid to the clothes dryer. Settings on the dryer control panel provide for selective choice between an extremely dry or damp condition for the drying operation.

It is an object of the present invention to provide a clothes dryer that operates as part of a home heating system.

It is another object of the invention to provide a clothes dryer that is cost-efficient.

It is another object of the invention to provide a clothes dryer that eliminates any chance of fire through its heating method.

It is yet another object of the invention to eliminate burning, scorching, and shrinking fabrics because temperatures are decreased and airflow increased because of the booster fan.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like components and elements of the apparatus of this invention will bear the same designations or numbering throughout the figures.

DESCRIPTION OF THE PREFERRED EMBODIMENT

Generally speaking, a clothes dryer that is operatively attached to a home heating system is illustrated. The clothes dryer is operatively attached to the home heating boiler and receives heated fluid when the dryer is turned on. The dryer comprises a radiator that receives the heated fluid from the fluid flow system. The fluid-filled radiator radiates heat into a clothes-drying chamber, which forms part of a motor-driven rotating drum. The rotating drum tumbles the clothes as heat is projected into the drying chamber, thus driving the moisture from the clothes.

Figure 1:
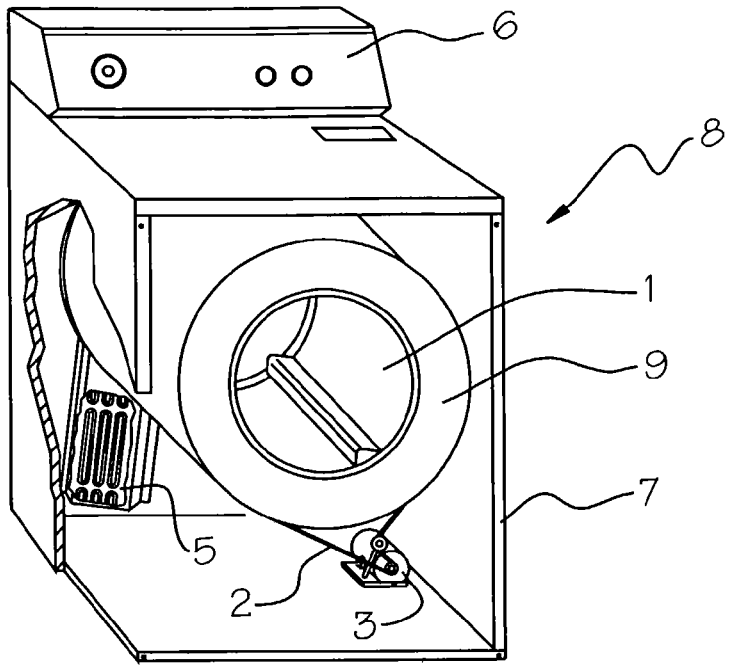
FIGURE 1 PRIOR ART
FIG. 1 illustrates a perspective front, cutaway view of a prior art clothes dryer.
Figure 2:
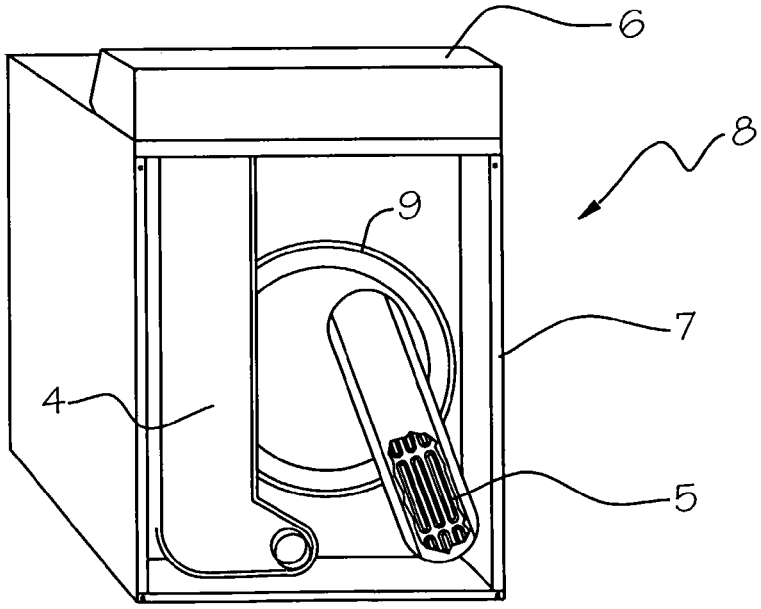
FIGURE 2 PRIOR ART
FIG. 2 depicts a perspective back, cutaway view of the prior art clothes dryer of FIG. 1.

Now referring to FIGS. 1 and 2, a prior art clothes dryer 8 is illustrated by front and rear perspective cutaway views. The clothes dryer 8 comprises a housing 7 containing a rotating drum 9 having an inner drying chamber 1, into which wet clothes (not shown) are deposited. The clothes dryer 8 has a control panel 6 for selecting the drying cycle and fabric type. The drum 9 obtains its heat from a set of electrical heating elements or coils 5. A venting system 4 draws the moisture-laden, heated air (not shown) from the drum 9, and vents the humid air to the atmosphere. The drum 9 is rotatively driven by means of a motor 3 and drive belt 2. Control panel 6 allows the user to select the desired type of drying cycle and fabric adjustment.

Figure 3:
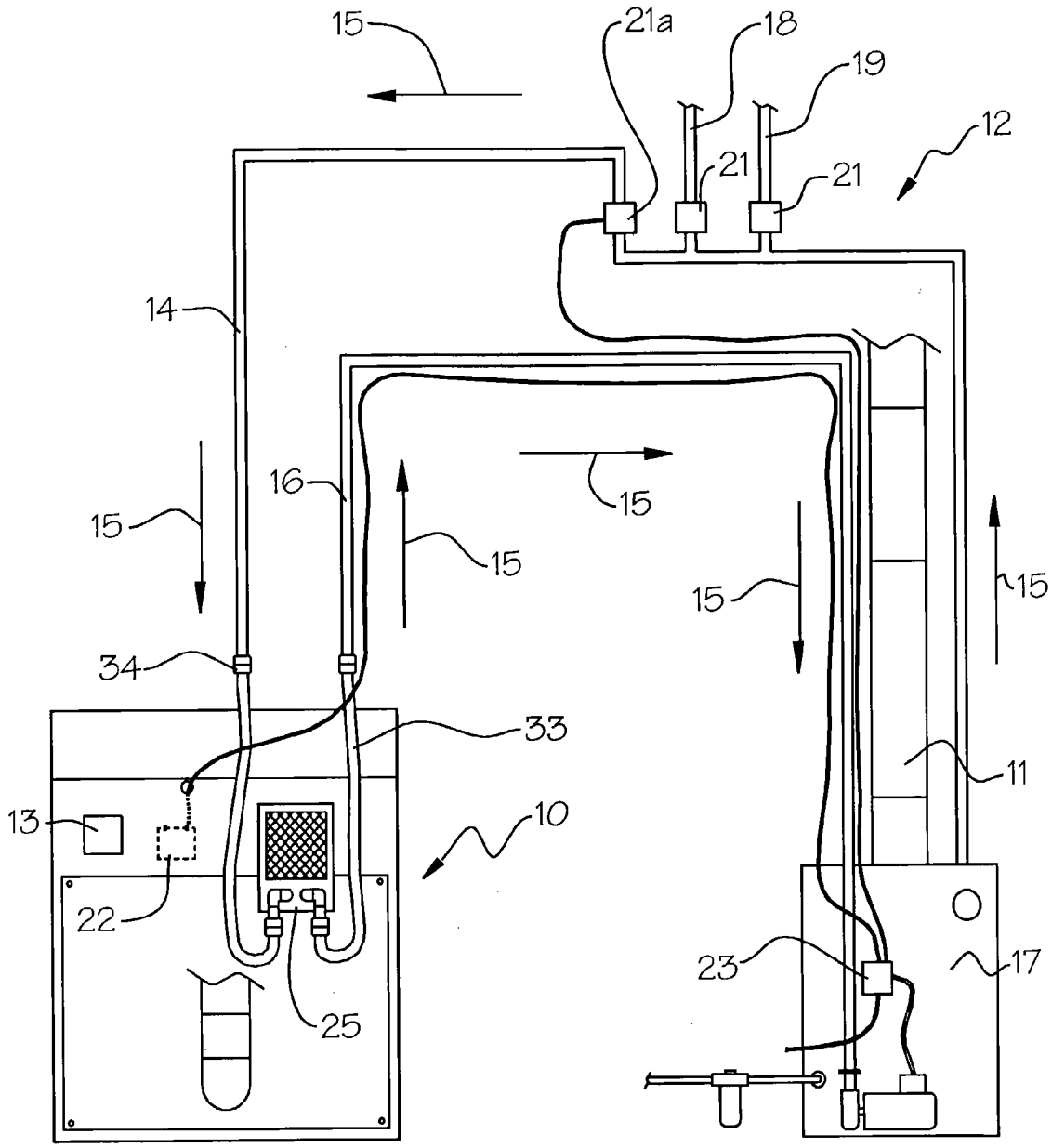
FIG. 3 shows a schematic view of the clothes dryer of this invention operatively attached to a home heating system.
Figure 7:
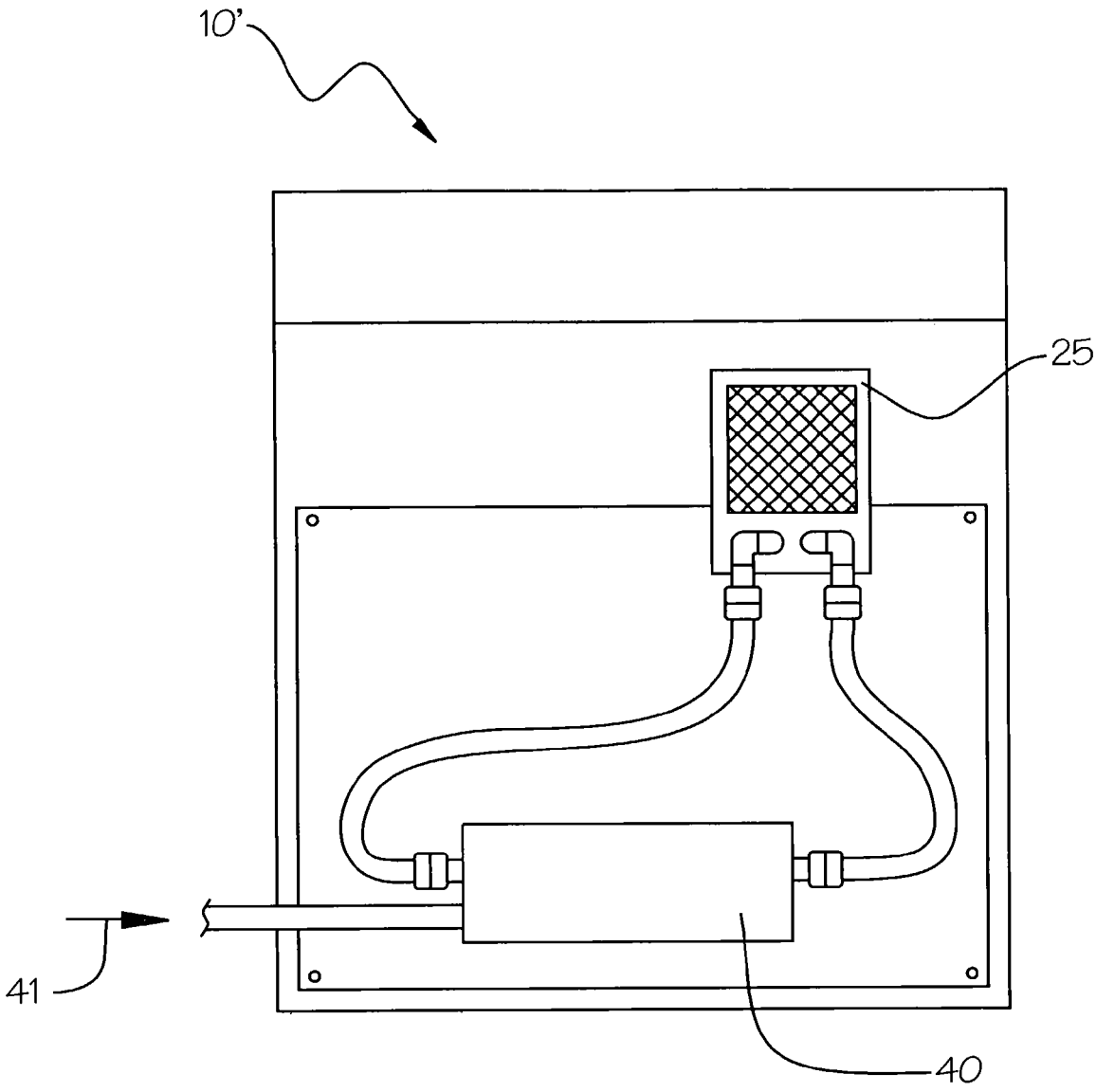
FIG. 7 is a schematic view of an alternate embodiment of the invention, showing a heating device as a part of the inventive, modified clothes dryer.

Referring to FIG. 3, the clothes dryer 10 of this invention is shown connected to the heating system for a home, generally shown by arrow 12. It should be understood that the invention is not limited to separate home heating systems, as shown in the preferred embodiment. A device or apparatus for generating heat 40 can be included in a modified clothes dryer 10', creating a safe, self-contained clothes dryer that is not directly dependent on electricity or gas, as shown in FIG. 7. Either gas or an electric line can be provided to heater 40, as shown by arrow 41. For purposes of this description, therefore, the term "heating system" is meant to include external or internal devices for generating heat. The clothes dryer 10 is essentially identical to the prior art clothes dryer depicted in FIGS. 1 and 2, with the exception of the lack of electric heating coils 5 or a gas heating mechanism (not shown).

The clothes dryer 10 of this invention obtains its heat from a heating system 12, via fluid flow piping represented by an intake pipe 14 and an outtake pipe 16 that connect to the furnace 17 containing a boiler for producing hot water and steam. The intake pipe 14 supplies heated fluid to various zones of the house through the off-take pipes 18 and 19, respectively (two zone heating). The intake pipe 14 actually represents a third, peripheral heating zone.

Arrows 15 generally show the fluid flow direction through the piping. The exhaust pipe 11 carries exhaust gases from the furnace 17. Zone control valves 21 allow heated fluid to flow from the furnace 17 to the various zones. A similar control 21*a* directs heated fluid to the clothes dryer 10. A relay 22 inside the clothes dryer 10 is electrically connected to the furnace control 23 to control the flow of fluid to the dryer 10 during the clothes drying cycle.

A sensor/timer 13 can control dry conditions and/or elapsed time. If clothing is meant to be dry, for example, the sensor/timer 13 can sense a level of moisture below which the clothes dryer 10 will terminate drying operation. Likewise, if the sensor/timer 13 is set for a predetermined time interval from the time clothes dryer operation commences, the operation of the clothes dryer 10 will terminate once the time interval has expired. Finally, a combination of the foregoing operations can be used with the sensor/timer 13. The clothes dryer 10 can terminate operations as soon as the earliest moisture or time conditions are met.

The heated fluid flowing in and out of the dryer 10 passes through a radiator 25. The radiator 25 is shown in more detail with respect to FIG. 5. The intake pipe 14 directs water to a number of fin-encrusted, heat exchanging tubes 28 disposed inside the radiator 25. The fins increase the surface area of the radiator 25, and improve the transfer of heat to the surrounding air. The filter 26 prevents buildup of dust and lint in the radiator 25.

Figure 4:
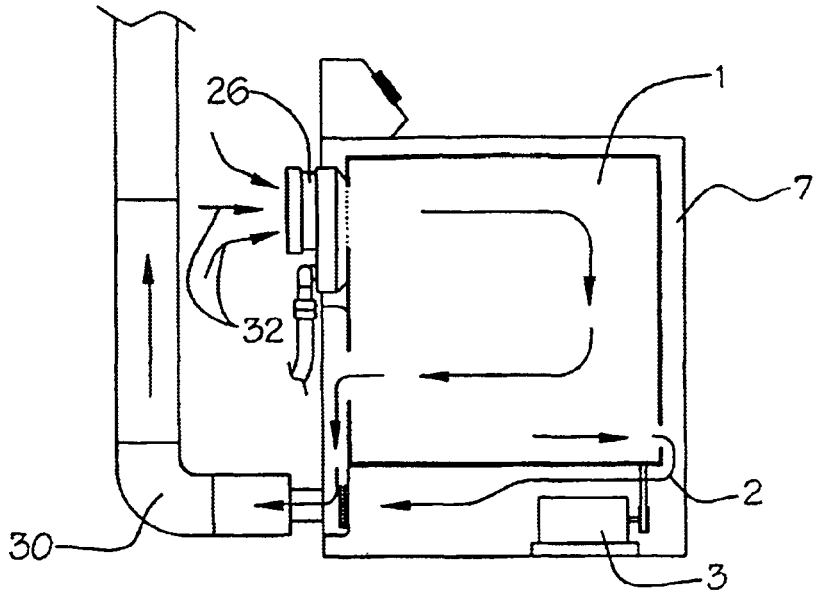
FIG. 4 illustrates a cutaway side view of the clothes dryer of this invention as shown in FIG. 3.
Figure 5:
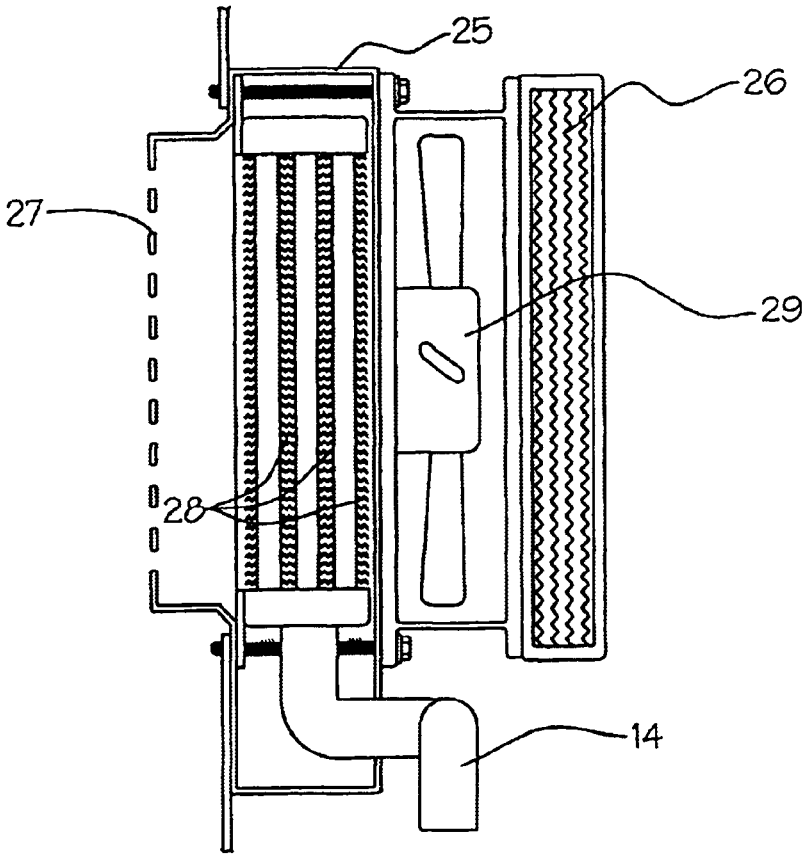
FIG. 5 depicts a cutaway side view of the heating apparatus of the clothes dryer shown in FIGS. 3 and 4.

Referring to FIG. 4, cool air is shown (arrows 32) being directed into the dryer 10 through an air inlet filter 26 disposed at the back of the dryer 10. The cool air is directed to the heat exchanger tubes 28 (FIG. 5). A small fan 29 draws the heated air through the radiator 25 into the inner chamber 1 of the drum 9. The fan 29 increases airflow through the radiator 25, thus increasing efficiency. The heated air enters into the inner chamber 1, circulates through the wet clothes, and then passes out the back of the clothes dryer 10 through the air vent system 4, and then through an air exhaust pipe 30. The exhaust pipe 30 may be enlarged to provide a better airflow than is standard on a dryer.

Figure 6:
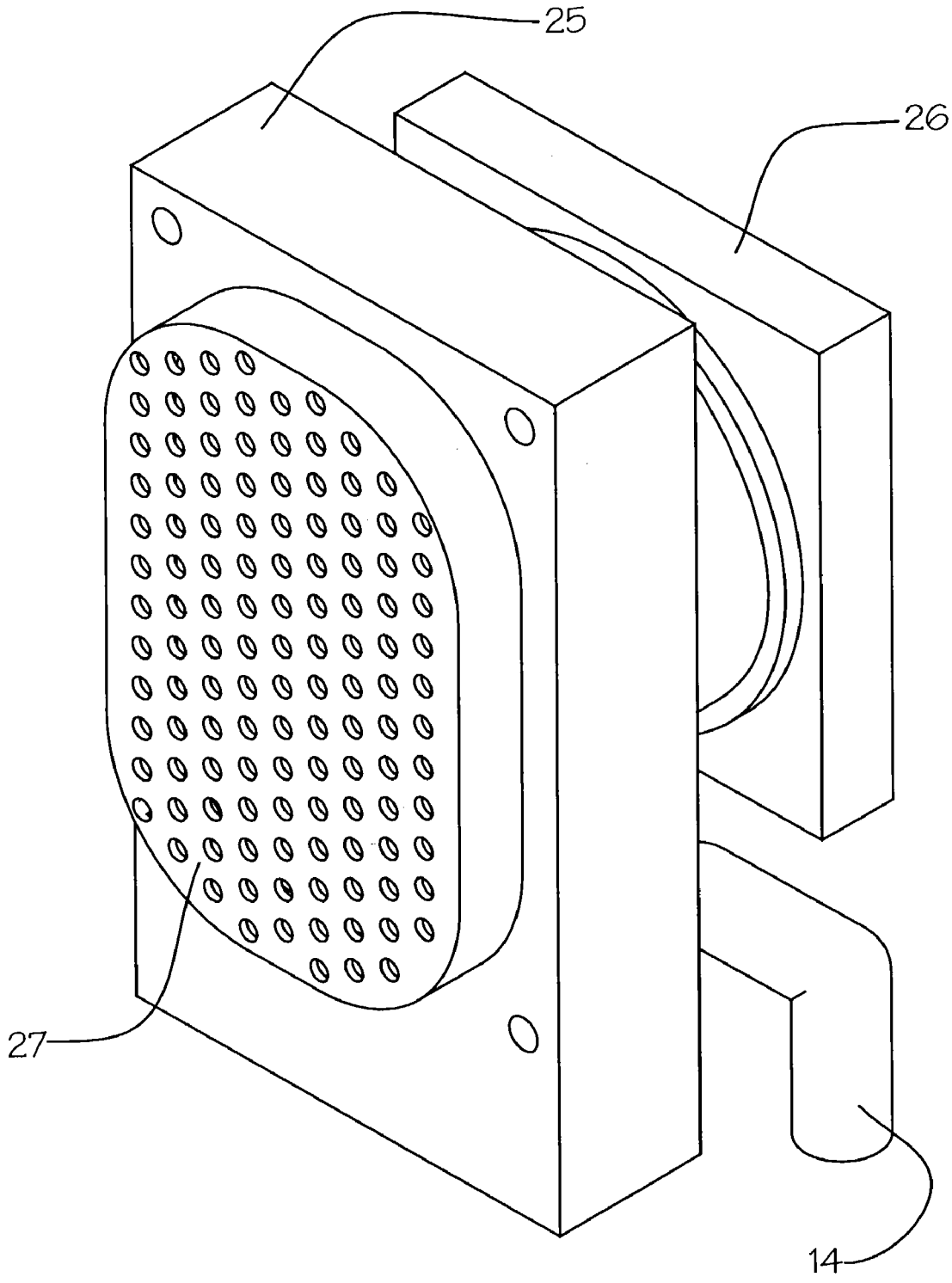
FIG. 6 shows an enlarged perspective view of the face-plate for directing heated air into the clothes dryer chamber.

The front end 27 of the radiator 25 is perforated to allow the air to pass into the inner chamber 1. An enlarged view of the perforated front end 27 of the radiator 25 is illustrated in FIG. 6. The size, shape, perforation, and location of the radiator front end 27 can be varied to fit any type of dryer or application. Flexible hoses 33 and quick disconnect couplers 34 make the appliance easily serviceable.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

Having thus described the invention, what is desired to be protected by Letters Patent is presented in the subsequently appended claims.

What is claimed is:

1. A clothes dryer system comprising, in combination, a modified clothes dryer comprising a clothes-drying chamber having a motor-driven, rotating drum, and a home heating apparatus, said modified clothes dryer being adapted to receive heated fluid from said home heating apparatus, and having a heat-exchanging radiator disposed proximate to and operatively connected to said clothes-drying chamber for transferring heat from said heated fluid to clothes that are to be dried and deposited therein.

2. The clothes dryer system in accordance with claim 1, further comprising means for circulating air disposed within said modified clothes dryer.

3. The clothes dryer system in accordance with claim 1, further comprising a sensor disposed in said modified clothes dryer for sensing when clothes deposited into said clothes drying chamber have reached a dry condition, said sensor sending a signal to said heating apparatus to terminate the flow of said heated fluid to said modified clothes dryer in response to said dry condition.

4. The clothes dryer system in accordance with claim 1, further comprising a control panel supported by said modified clothes dryer, said control panel having means for generating a signal instructing said heating apparatus to supply said heated fluid to said modified clothes dryer.

5. The clothes dryer system in accordance with claim 3, further comprising a timer that is settable to deactivate flow of said heated fluid into said modified clothes dryer when said timer expires.

6. The clothes dryer system in accordance with claim 1, further comprising a timer disposed in said modified clothes dryer for setting a predetermined time interval, said timer sending a signal to said heating apparatus to terminate the flow of said heated fluid to said modified clothes dryer when said predetermined time interval has expired.

7. The clothes dryer system in accordance with claim 2, further comprising a filter operatively connected to said means for circulating air for filtering out laundry lint.

8. A clothes drier for heating wet or damp clothes using heat obtained from a home heating apparatus, said clothes dryer having a rotating drum for tumbling clothes, said rotating drum comprising an inner chamber for accepting clothes needing to be dried, drive means disposed in said clothes dryer for rotating said rotating drum, an air circulating means for circulating air through said inner chamber, a heat-exchanging radiator external to and non-contiguous with said rotating drum for accepting heated fluid from said home heating apparatus and transferring its heat to said air being circulated in said inner chamber of said rotating drum, whereby said clothes are heated, tumbled, and dried.

9. The clothes dryer in accordance with claim 8, further comprising a sensor disposed within said clothes dryer for sensing when clothes are substantially dry, said sensor providing a signal to terminate said heated fluid being supplied by said home heating apparatus.

10. The clothes dryer in accordance with claim 8, further comprising a control panel supported by said clothes dryer, said control panel having means to signal said home heating apparatus to supply heated fluid to said clothes dryer.

11. The clothes dryer in accordance with claim 8, further comprising exhaust means for exhausting moisture-laden air, said exhaust means disposed at a rear portion of said clothes dryer, and having communication with said inner chamber.

12. The clothes dryer system in accordance with claim 8, wherein said air circulating means comprises a fan.

13. A clothes dryer that uses heated fluid from a home heating apparatus, comprising a clothes drying drum supported in a housing, said clothes drying drum having an inner chamber for tumbling clothes in need of drying, a heat-exchanging radiator supported in said housing and non-contiguous with said clothes drying drum for accepting heated fluid from said heating apparatus, and for transferring heat to said drying drum and said clothes being tumbled therein.

14. The clothes dryer in accordance with claim 13, further comprising a sensor disposed within said clothes dryer for sensing when clothes are substantially dry, said sensor providing a signal to terminate said heated fluid being supplied by said heating apparatus.

15. The clothes dryer in accordance with claim 13, further comprising a timer that is settable to deactivate input of heated fluid into said clothes dryer when dry condition occurs or timer expires, whichever comes first.

16. The clothes dryer in accordance with claim 13, further comprising a control panel supported by said clothes dryer, said control panel having means to signal said heating apparatus to supply heated fluid to said clothes dryer.

17. The clothes dryer in accordance with claim 13, further comprising exhaust means for exhausting moisture-laden air, said exhaust means disposed at a rear portion of said clothes dryer, and having communication with said inner chamber.

18. A clothes dryer system comprising, in combination, a modified clothes dryer comprising a clothes-drying chamber having a motor-driven, rotating drum, and a heating element, and a home heating apparatus, said modified clothes dryer being adapted for heating a fluid passed therethrough to produce a heated fluid, said heated fluid being useful for heating a home.

19. The clothes dryer system in accordance with claim 18, further comprising means for circulating air disposed within said modified clothes dryer.

* * * * *